US007454148B2

(12) United States Patent
Kameda

(10) Patent No.: US 7,454,148 B2
(45) Date of Patent: Nov. 18, 2008

(54) IMAGE FORMING APPARATUS

(75) Inventor: Akihito Kameda, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/101,582

(22) Filed: Apr. 8, 2005

(65) Prior Publication Data

US 2005/0238370 A1 Oct. 27, 2005

(30) Foreign Application Priority Data

Apr. 14, 2004 (JP) ..... 2004-119503
Feb. 18, 2005 (JP) ..... 2005-042277

(51) Int. Cl.
*G03G 21/12* (2006.01)

(52) U.S. Cl. ..... 399/35

(58) Field of Classification Search ..... 399/35, 399/27, 60, 8, 34, 358
See application file for complete search history.

(56) References Cited

U.S. PATENT DOCUMENTS 4,982,231 A * 1/1991 Matsuuchi ..... 399/35
5,594,529 A * 1/1997 Yamashita et al. ..... 399/8
5,918,085 A * 6/1999 Rollins et al. ..... 399/35
5,937,225 A * 8/1999 Samuels ..... 399/27
6,584,291 B1 * 6/2003 Yamamoto ..... 399/27

FOREIGN PATENT DOCUMENTS

JP 8-152816 6/1996

* cited by examiner

*Primary Examiner*—David M Gray
*Assistant Examiner*—Erika J. Villaluna
(74) *Attorney, Agent, or Firm*—Oblon, Spivak, McClelland, Maier & Neustadt, P.C.

(57) ABSTRACT

There is provided an image-forming apparatus having a transmitting and receiving device for transmitting and receiving system information to a host computer by way of a data communication line; a detection device for detecting the amount of toner deposited on the photoreceptor in the developing unit of the image-forming apparatus; a counting device for counting the number of images to be printed; and a near-full detection device for detecting the near-full state of waste toner by using the detection device and the counting device.

15 Claims, 7 Drawing Sheets

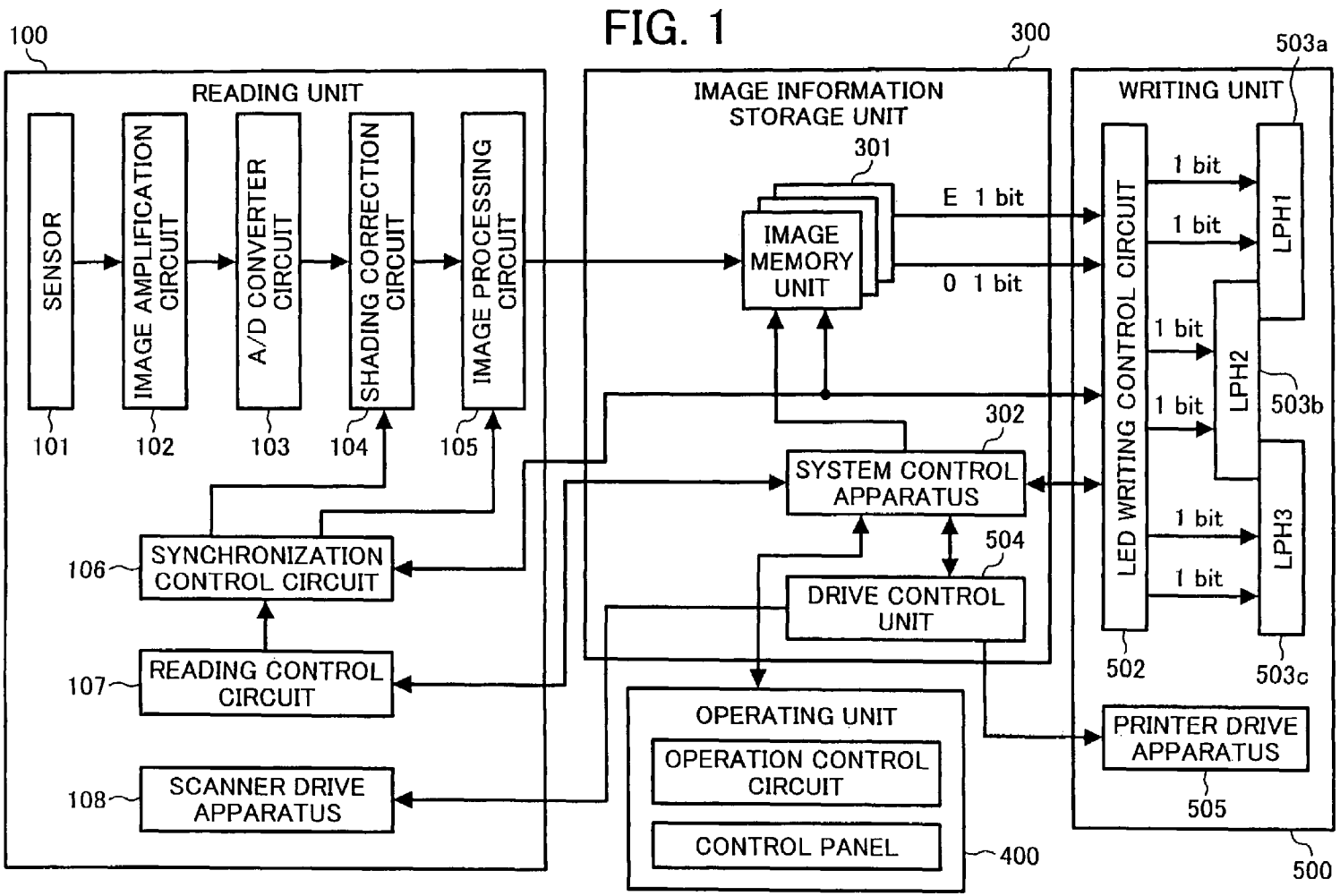
FIG. 1
WRITING UNIT
503a
LPH1
503b
LPH2
503c
LPH3
1 bit
LED WRITING CONTROL CIRCUIT
502
PRINTER DRIVE APPARATUS
505
500
300
IMAGE INFORMATION STORAGE UNIT
301
E 1 bit
O 1 bit
IMAGE MEMORY UNIT
302
SYSTEM CONTROL APPARATUS
504
DRIVE CONTROL UNIT
400
OPERATING UNIT
OPERATION CONTROL CIRCUIT
CONTROL PANEL
100
READING UNIT
SENSOR
101
IMAGE AMPLIFICATION CIRCUIT
102
A/D CONVERTER CIRCUIT
103
SHADING CORRECTION CIRCUIT
104
IMAGE PROCESSING CIRCUIT
105
SYNCHRONIZATION CONTROL CIRCUIT
106
READING CONTROL CIRCUIT
107
SCANNER DRIVE APPARATUS
108

FIG. 7

| NONVOLATILE RAM ADDRESS | CHARGING VOLTAGE | BIAS VOLTAGE | TRANSFER CURRENT | PIXEL COUNT VALUE | TONER TRANSFER AMOUNT |
|---|---|---|---|---|---|
| 100000 h | 1100 V | 600 V | 10 μA | 0–99999 | 0 |
| 100001 h | ↑ | ↑ | ↑ | 100000–199999 | 1 |
| ... | ... | ... | ↑ | ... | ... |
| 1000FF h | ↑ | ↑ | ↑ | 200000000– | 200 |
| 100100 h | ↑ | ↑ | 20 μA | 0–99999 | 2 |
| 100101 h | ↑ | ↑ | ↑ | 100000–199999 | 4 |
| ... | ... | ... | ... | ... | ... |
| 1001FF h | ↑ | ↑ | ↑ | 200000000– | 210 |
| ... | ... | ... | ... | ... | ... |
| 112BFF h | 1300 V | 800 V | 230 μA | 200000000– | 250 |

IMAGE FORMING APPARATUS

BACKGROUND OF THE INVENTION

1. Field of the Invention

The present invention relates to image-forming apparatuses such as copiers, printers, and facsimiles, etc., that reduce the occurrence of downtime.

2. Description of the Related Art

In recent years, the components of image-forming apparatuses, and toner and other consumable components in particular, have become "unitized," as it is referred to, and the user can perform maintenance on the image-forming apparatus by exchanging the consumed unit. Machines that print documents using an image-forming apparatus have furthermore become more widespread, and the apparatus stops operation when the unit has been consumed to a fixed amount. In other words, downtime occurs. In such a case, the consumed unit must be quickly replaced to minimize downtime.

An example of such technology is disclosed in Japanese Patent Application Laid-open No. 8-152816 relating to an image-forming apparatus that can reduce the downtime caused by depleted consumable components.

Conventionally known is a system in which a sensor detects (waste toner tank near full) that the amount of toner (hereinafter referred to as "waste toner") left as a residue on the photodetector and recovered by the cleaning unit has exceeded a fixed amount. However, since the sensor is a mechanical sensor, the time until operation of the machine is prohibited varies depending on how frequently the apparatus is used, and the actual timing for exchanging the tank is not apparent, and in certain cases, the administrator cannot adequately respond, resulting in apparatus downtime.

SUMMARY OF THE INVENTION

The present invention was contrived in view of such circumstances, and an object thereof is to provide an image-forming apparatus that reduces the occurrence of downtime.

In accordance with the present invention, there is provided an image-forming apparatus having a transmitting and receiving device for transmitting and receiving system information to and from a host computer by way of a data communication line, comprising a detection device for detecting the amount of toner deposited on the photoreceptor in the developing unit of the image-forming apparatus; a counting device for counting the number of images to be printed; and a near-full detection device for detecting the near-full state of waste toner by using the detection device and the counting device.

BRIEF DESCRIPTION OF THE DRAWINGS

The above and other objects, features and advantages of the present invention will become more apparent from the following detailed description taken with the accompanying drawings in which:

FIG. 1 is a block diagram showing the functional structure of the digital copier of the present invention;

FIG. 7 is a chart showing the relationship between the pixel count value, and the related toner transfer amount and the like.

DESCRIPTION OF THE PREFERRED EMBODIMENTS

Figure 2:
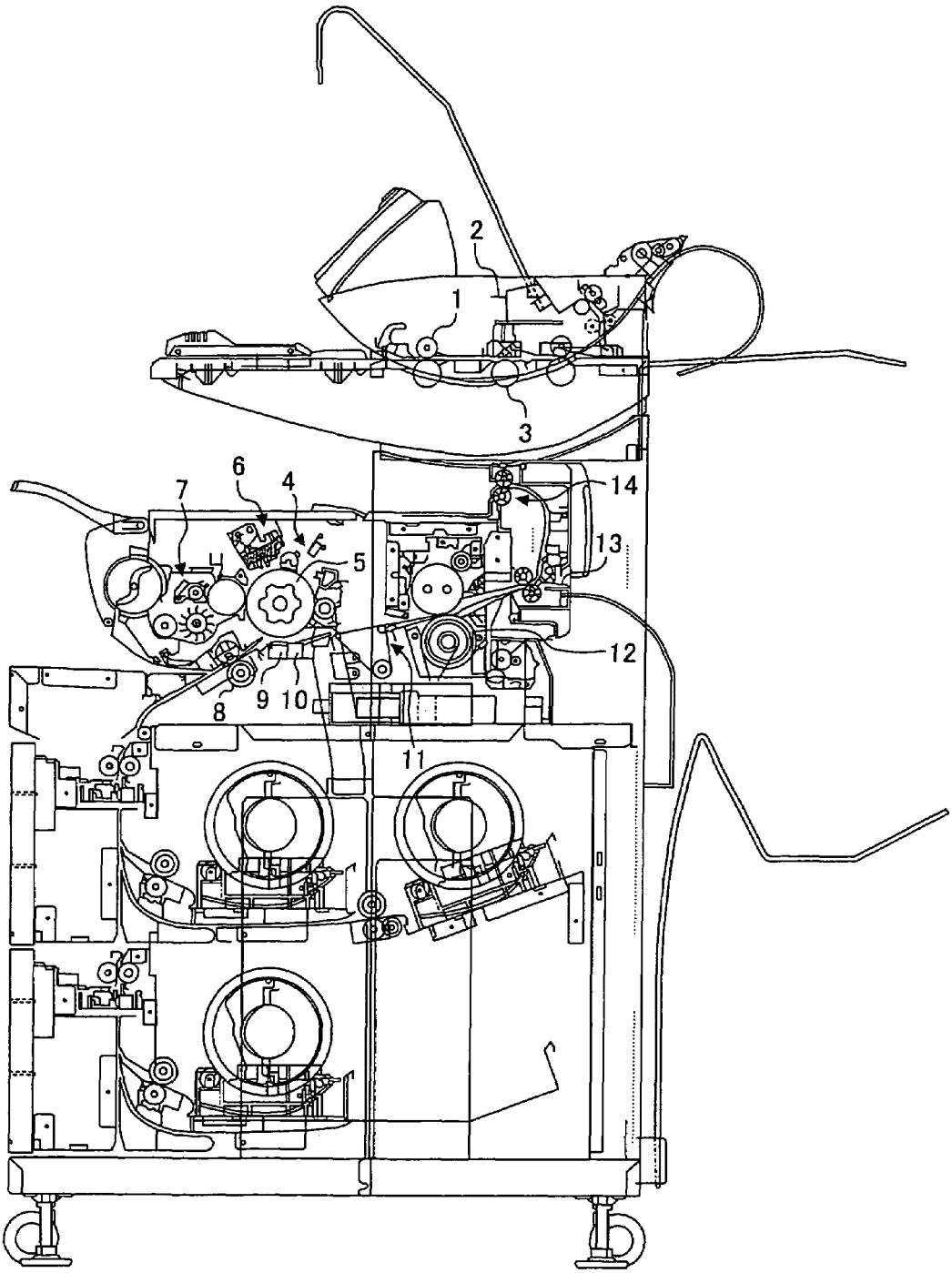
FIG. 2 is a diagram showing the internal structure of the digital copier of FIG. 1.

Described below with reference to the attached diagrams is a digital copier as an embodiment of the image-forming apparatus of the present invention.

Embodiment 1

FIG. 1 is a block diagram showing the functional structure of the digital copier of the present invention. The digital copier has a document reader 100 as a reading device for reading documents, an image information storage unit 300 as a storage device for storing document information thus read, and a writing unit 500 for copying the stored information to transfer paper. Also included in the configuration is a system control apparatus 302 for controlling the execution of a series of processes, a operating unit 400 as an operating device that carries out key input to the system control apparatus, and other components.

Described next is the configuration of the document reader 100 with reference to FIGS. 1 and 2.

When the operator inserts a document from the insertion port, the document is conveyed between a contact sensor 2 and a white roller 3 in accordance with the rotation of the roller 1. The document during conveyance is illuminated by light from an LED mounted in the contact sensor 2, the reflected light thereof forms an image in the contact sensor 2, and the document image information is read. The document image formed on the sensor 101 of FIG. 1 is converted to an electrical signal, and the analog signal is amplified by the image amplification circuit 102. The A/D converter circuit 103 converts the analog image signal amplified by the image amplification circuit 102 into a multi-valued digital image signal for each pixel. The converted digital image signal is synchronized with the clock output from the synchronization control circuit 106 and is then output, and distortions caused by nonuniformity in the luminous energy, soiling of the contact glass, nonuniformity of the sensitive of the sensor 101, and other factors are corrected in the shading correction circuit 104. The corrected digital image information is converted to digital recording image information in the image-processing circuit 105, and is then written to the image memory unit 301.

Described next is the configuration of the writing unit 500 and system control apparatus 302 that controls the series of processes that form on transfer paper the image signal written in the image memory unit 301.

The system control apparatus 302 has a function for controlling the entire digital copier, and drives the motor and other components via a scanner drive apparatus 108 and a printer drive apparatus 505 by using the drive control circuit 504 and data transfer in the read control circuit 107, the synchronization control circuit 106, the image memory unit 301, and the LED writing control circuit 502 to ensure the smooth conveyance of transfer paper and documents to be read.

In the writing unit 500, image signals transmitted by the synchronization signal clock from the image memory unit 301 are converted into single pixel unit bits by the LED writing control circuit 502, and are then converted and output as infrared light in the LPH503.

The process that includes the application of toner on the recording paper is described next with reference to FIG. 2.

The charged device 4 is a component that is referred to as a scorotron charger with a grid for uniformly charging the photodetector drum 5 to 1,200 V. The light emitting element array unit 6 is arranged in the form of an array of LEDs, and illuminates the photodetector drum 5 by way of an SLA (self-focusing lens array). The LED head of the light emitting element array unit 6 corresponds to LPH503 shown in FIG. 1. When the photodetector drum 5 is illuminated by LED light on the basis of the digital image information, the electric charge on the surface of the photodetector flows to the ground of the drum 5 and is eliminated. In this arrangement, the portions where the density of the document is light are such that the LEDs are not caused to illuminate, and the portions where the density of the document is considerable are such that the LEDs are caused to illuminate. An electrostatic latent image in correspondence with the light and dark portions of the image is thereby formed by the portions on the photodetector drum that are not illuminated with LED light. This electrostatic latent image is developed by a developing unit 7. The toner in the developing unit 7 is given a negative electrical charge by stirring, and since a bias of 700 V is applied, the toner adheres exclusively to the portions illuminated by LED light.

The transfer paper is selected from the automatic paper feeder or the manual paper feeder and passed under the photodetector drum 5 with a prescribed timing by a resist roller 8, and the toner image is transferred at this time by a transfer charger 9 to the transfer paper. The transfer paper is subsequently separated from the photodetector drum 5 by a separation charger 10 and conveyed from a conveyance tank 11 to a fixing unit 12, and the toner is fixed to the transfer paper therein. Transfer paper on which the toner has been fixed is conveyed forward or backward and discharged from the machine by a paper discharge tray 13 or 14.

Described next is the flow of the image signal from the image memory unit 301 to the writing unit 500.

The flow of the image signal is configured so that even (E) and odd (O) bi-valued image data is sent from the image memory unit 301 to the LED writing control circuit 502 at 25 MHz in two parallel lines. The image signal sent by the two lines is temporarily combined into a single line in the LED writing control circuit 502, then divided into two signals per LED, divided into six signals overall, and transmitted to the LED heads 503*a*, 503*b*, and 503*c* at 9.5 MHz.

Of the bi-valued image data that is input from the image memory unit 301 to the writing unit 500 at this time, the black data (1) transmitted to the LPH503*a* to 503*c* is counted in the LED writing control circuit 502. The count up interval is the document read interval, and once the count up interval is completed, the data is then latched and stored in the register. The stored count data is transmitted to the system control apparatus 302.

Figure 3:
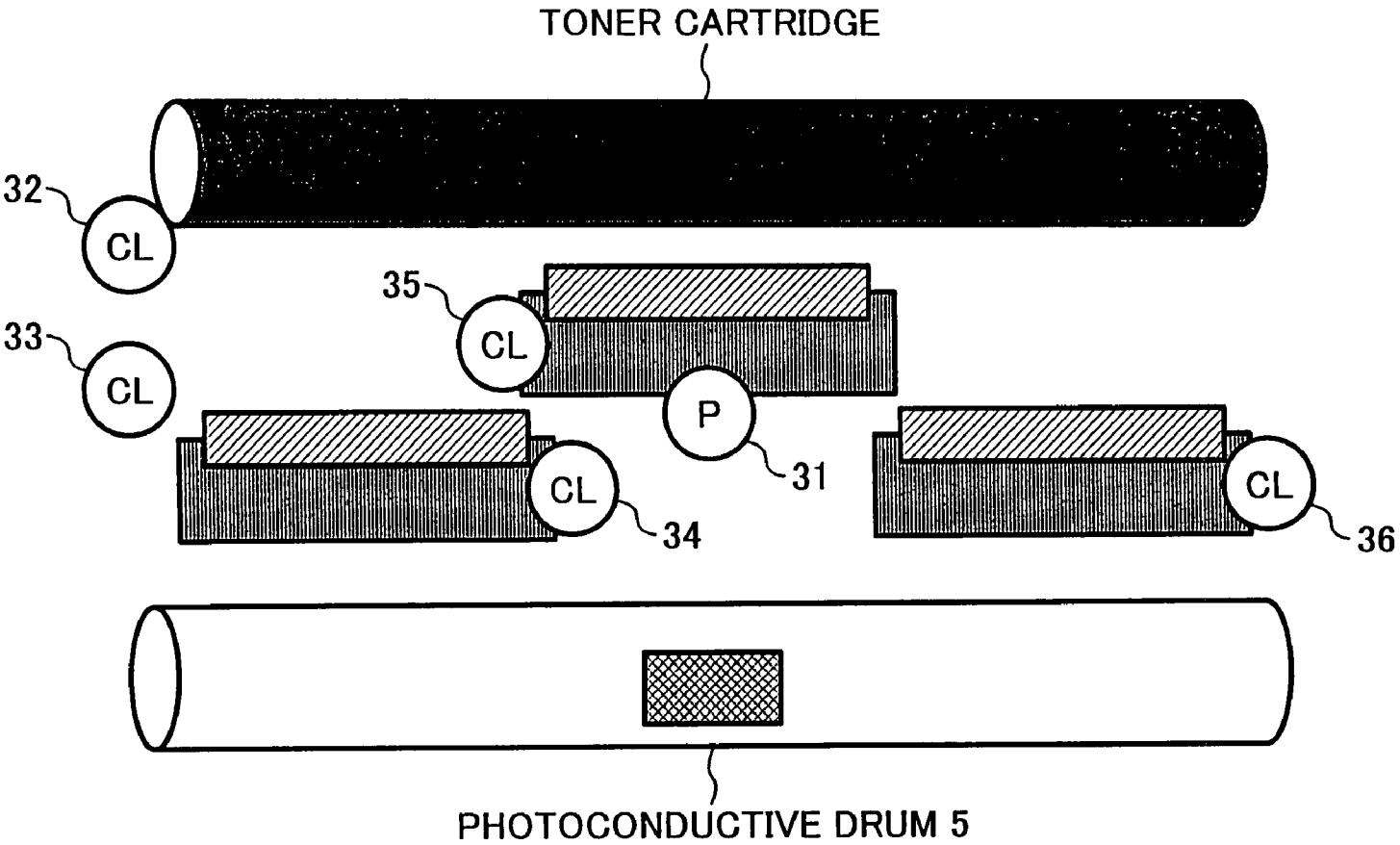
FIG. 3 is a diagram showing the internal structure of the developing unit in the digital copier of FIG. 1.

In the system control apparatus 302, the dot count value at the start of toner feeding is set as the reference value by the P sensor 31 shown in FIG. 3, the left and right dot count values and the center dot count value are compared in the CPU, and the amount of toner to be fed to the left and right of the developing unit is determined. In accordance with the amount of toner to be fed thus determined, the CPU communicates with the drive control circuit 504, and the drive control circuit 504 drives the toner supplies CL32 and 33 as well as the shutters CL34, 35, and 36.

The waste toner amount α in this case is represented by the following formula (1).

The toner amount $\alpha_n$ used for a single copy in a developing unit is $$\alpha_n = m_1 \times \frac{S}{N} \times \left(D_n \div \frac{D_{all}}{N}\right) \times K + \left(T_{bias} \times V_{drum} \times \frac{H}{N} - \frac{S}{N} \times \left(D_n \div \frac{D_{all}}{N}\right) \times K\right) \times m_2 \quad \text{Eq. (1)}$$

where N is the number of divisional units in the developing unit, $m_1$ is the toner deposited on the image unit (mg/cm$^2$), $m_2$ is the toner deposited on the surface portion (mg/cm$^2$), S is the surface area of the recording paper (cm$^2$), $D_n$ is the number of dots written in a developing unit, $D_{all}$ is the total number of dots on a single recording paper, K is the correction coefficient, $T_{bias}$ is the applied length of time (sec) of the bias, $V_{drum}$ is the linear velocity (cm/sec) of the photodetector, and H is the effective developing width (cm).

From the formula (1) above, the toner amount α on a single sheet (surface area S) is $$\alpha = \sum_{n=1}^{N} \alpha_n \quad \text{Eq. (2)}$$

The total toner amount β used in image formation is therefore represented by the following formula (3).

$$\beta = \Sigma\alpha \quad \text{Eq. (3)}$$

Figure 4:
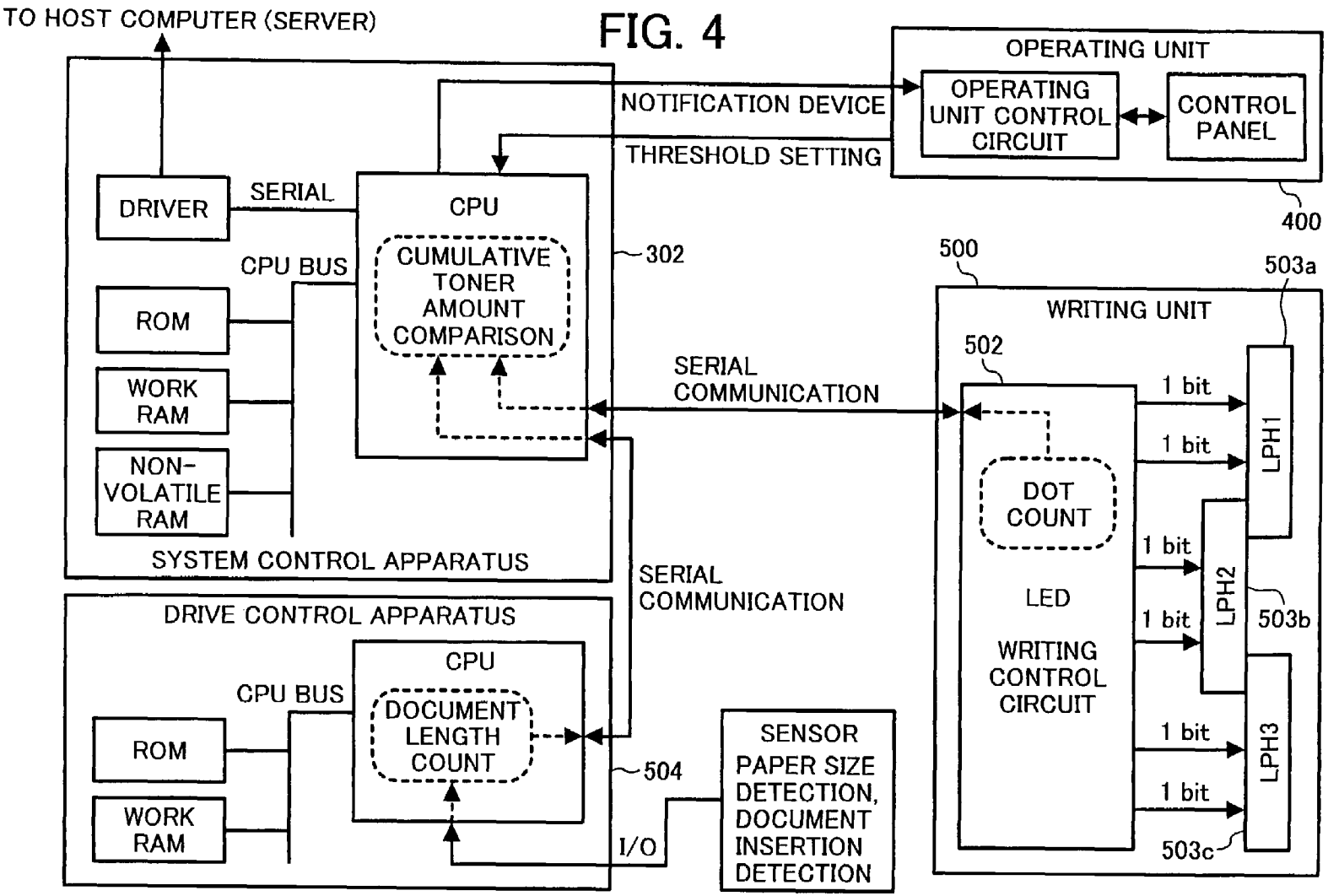
FIG. 4 is a diagram that describes the operation for providing notification that the waste toner is near full in the digital copier of FIG. 1.

The total amount of waste toner (toner feed amount−β) calculated by using the above formula is stored in nonvolatile RAM in the main unit and compared with the threshold value preset in the CPU, and if the total amount is greater than the threshold value, the operator is notified (waste toner near full), the information is displayed on the control panel, and the host computer is notified by way of a communication line, as shown in FIG. 4

Figure 5:
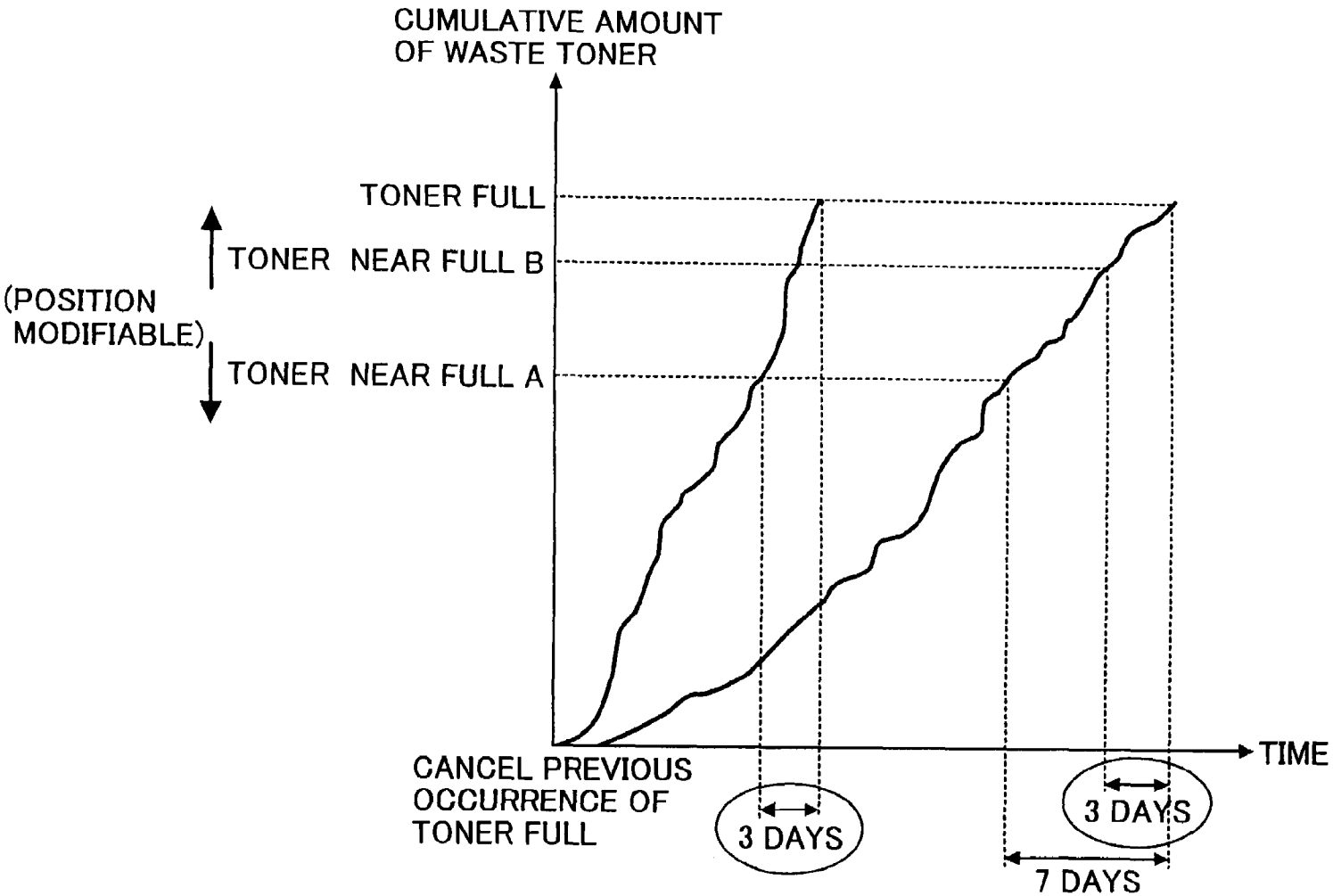
FIG. 5 is a diagram showing situations in which the near-full setting value is modified in the digital copier of FIG. 1.

The threshold value can be modified using the control panel 400 and can be set by the operator in association with the frequency of use of the apparatus. The workload of the operator can be reduced by coordinating the devices in the host system so as to provide notification that the waste toner will be full in three days, for example, as shown in FIG. 5.

Figure 6:
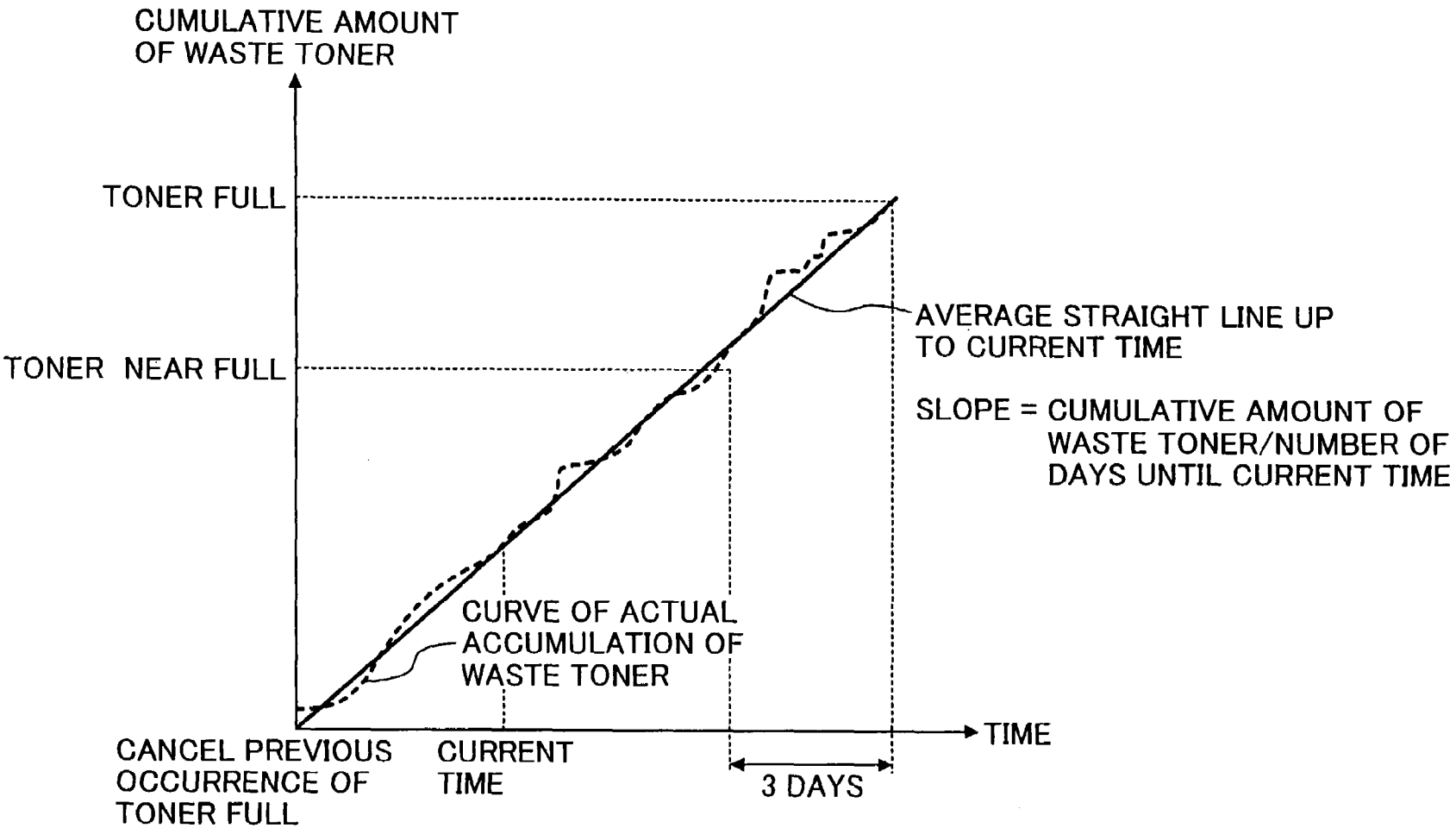
FIG. 6 is a diagram showing situations in which the estimated time until the toner is near full is calculated in the digital copier of FIG. 1.

A configuration is also possible in which a time function and a nonvolatile memory for storing the time function are provided inside the apparatus, as shown in FIG. 6, the time when the previous near-full state or full state was canceled and the time when the near-full state occurred in the current cycle are compared, and if there is a device for calculating the estimated remaining time until the toner is full in the current cycle, the time remaining until full is set based on the frequency of use whereby the host computer is notified when the time remaining until a full state is reached is three days, for example, and the administrator's work of setting the threshold limit can therefore be eliminated.

It is apparent from the above description that using the image-forming apparatus of the present embodiment allows the host computer to manage the state of the waste toner without the use of a dedicated sensor, facilitates administrator management, and further allows the downtime of the apparatus to be reduced.

The near-full state can be set in association with the frequency of use, and the workload of the administrator can be lightened and the downtime can be reduced by coordinating the time from "toner near full" to "toner full" with the other devices in the host system.

It is also possible to dispense with the administrator's work of setting the threshold.

Embodiment 2

Described next is the digital copier of the present embodiment, but the following diagrams are the same as FIGS. 1 to 6: the block diagram showing the functional structure of the digital copier, the diagram showing the internal structure of the digital copier, the diagram that describes the operation for providing notification that the waste toner is near full, the diagram showing situations in which the near-full setting value is modified, and the diagram showing situations in which the estimated time until the toner is near full is calculated, and a description of the common components is omitted.

The process that includes the application of toner on the recording paper is described next with reference to FIG. 2.

The charged device 4 is a component that is referred to as a scorotron charger with a grid for uniformly charging the photodetector drum 5 to 1,200 V. The light emitting element array unit 6 is arranged in the form of an array of LEDs with a density of 600 elements per inch (25.4 mm), and achieves a writing density of 600 dpi. The light emitted from the LED illuminates the photodetector drum 5 by way of an SLA (self-focusing lens array). The LED head of the light emitting element array unit 6 corresponds to LPH503 shown in FIG. 1. The LPH503*a* to *c* each have a light-emitting element with 7,400 dots, and cover a printing width of about 313 mm. The three LPH503*a* to *c* are disposed so as to overlap by 10 mm, and can print overall with 21,730 pixels per line, and a width of about 920 mm. When the photodetector drum 5 is illuminated by LED light on the basis of the digital image information, the electric charge on the surface of the photodetector flows to the ground of the drum 5 and is eliminated. In this arrangement, the portions where the density of the document is light are such that the LEDs are not caused to illuminate, and the portions where the density of the document is considerable are such that the LEDs are caused to illuminate. An electrostatic latent image in correspondence with the light and dark portions of the image is thereby formed by the portions on the photodetector drum that are not illuminated by LED light. This electrostatic latent image is developed by a developing unit 7. The toner in the developing unit 7 is given a negative electrical charge by stirring, and since a bias of 700 V is applied, the toner adheres exclusively to the portions illuminated by LED light.

The transfer paper is selected from the automatic paper feeder or the manual paper feeder and passed under the photodetector drum 5 with a prescribed timing by a resist roller 8, and the toner image is transferred at this time by a transfer charger 9 to the transfer paper. The initial value of the transfer current is 60 μA. The amount of toner deposited on the drum 5 and the amount of toner transferred varies in accordance to modifications made to the series of imaging conditions (charging voltage of the drum, bias voltage of the toner, transfer current, and the like). The charging voltage of the drum can be set in steps of 50 V between 1,100 V and 1,300 V, and the bias voltage of the toner can be set in steps of 50 V between 600 V and 800 V. The transfer current can be set in intervals of 1 μA between 10 μA and 230 μA. The setting may be carried out automatically by checking the imaging conditions at the time of power ON, or the value may be directly set from the control panel 400.

The transfer paper is subsequently separated from the photodetector drum 5 by the separation charger 10 and conveyed from the conveyance tank 11 to the fixing unit 12, and the toner is fixed to the transfer paper therein. Transfer paper on which the toner has been fixed is conveyed forward or backward and discharged from the machine by a paper discharge tray 13 or 14.

Described next is the flow of the image signal from the image memory unit 301 to the writing unit 500.

The flow of the image signal is configured so that even (E) and odd (O) bi-valued image data is sent from the image memory unit 301 to the LED writing control circuit 502 at 25 MHz in two parallel lines. The image signal sent by the two lines is temporarily combined into a single line in the LED writing control circuit 502, divided into two signals per LED, divided into six signals overall, and transmitted to the LED heads 503*a*, 503*b*, and 503*c* at 9.5 MHz.

Of the bi-valued image data input from the image memory unit 301 to the writing unit 500 at this time, the black data (1) transmitted to the LPH503*a* to 503*c* is counted in the LED writing control circuit 502. The count up interval is the interval in which actual writing is performed by the LPH503, and once the count up interval is completed, the data is then latched and stored in the register. The writable length is a maximum of 1,300 mm, and is therefore about 30,000 lines. Therefore, the count value is a maximum of about 222,000,000. The stored count data is transmitted to the system control apparatus 302.

In the system control apparatus 302, the deposited amount of toner of the developers is quantified by the value of the P sensor 31 and the dot count of writing control, and the result is stored in the RAM in the system control apparatus 302. The dot count values corresponding to the developers are counted by image transfer, the toner density is detected by the P sensor in the center developer, and the toner is fed when the density has decreased. The amount of toner fed to the left and right developers at this time is determined by comparing the center dot count value and the left and right dot count values in the CPU. In accordance with the amount of toner to be fed thus determined, the CPU communicates with the drive control circuit 504, and the drive control circuit 504 drives the toner supplies CL32 and 33 as well as the shutters CL34, 35, and 36.

A plurality of tables of pixel count values and toner transfer amounts corresponding thereto are stored in advance in the nonvolatile RAM in the system control apparatus 302 in correspondence with the imaging (*1) conditions for forming images, as shown in FIG. 7. In other words, the system has a table of pixel count values and toner transfer amounts that correspond thereto in accordance with the setting values of the charging voltage of the drum, the bias voltage of the toner, and the transfer current. Since the transfer amount does not vary considerably if the setting values are slightly modified, the charging voltage of the drum and the bias voltage of the toner in the table are modified in steps of 50 V, and the transfer current in the table is modified in steps of 20 μA. The table to be used is determined from the plurality of tables on the basis of the imaging conditions, and the toner transfer amount is computed in accordance with the pixel count value of the black pixels to be transferred to LPH503*a* to 503*c* using the table thus determined.

The waste toner amount α in this situation is expressed in the following formula (4).

$$\alpha=\beta-\gamma \qquad \text{Eq. (4)}$$

In the formula, α is the waste toner amount, β is the toner fed amount, and γ is the toner transfer amount.

The total amount of toner δ used in image formation is therefore expressed in the following formula (5).

$$\delta=\Sigma\alpha \quad \text{Eq. (5)}$$

In the formula, δ is the total amount of waste toner.

The total amount of waste toner δ calculated using the formula above is stored in the nonvolatile RAM of the main system and compared with the preset threshold in the CPU, as shown in FIG. 4. If the total exceeds the threshold value, the operator is notified (waster toner near full), the notification is displayed in the control panel, and the host computer is notified by way of a communication line.

The threshold value can be modified using the control panel 400 and can be set by the operator in association with the frequency of use of the apparatus. The workload of the operator can be reduced by coordinating the devices in the host system so as to provide notification that the waste toner will be full in three days, for example, as shown in FIG. 5.

A configuration is also possible in which a time function and a nonvolatile memory for storing the time function are provided inside the apparatus, as shown in FIG. 6, the time when the previous near-full state or full state was canceled and the time when the near-full state occurred in the current cycle are compared, and if there is a device for calculating the estimated remaining time until the toner is full in the current cycle, the time remaining until full is set based on the frequency of use whereby the host computer is notified when the time remaining until a full state is reached is three days, for example, and the administrator's work of setting the threshold limit can therefore be eliminated.

It is apparent from the above description that using the image-forming apparatus of the present embodiment allows the host computer to manage the state of the waste toner without the use of a dedicated sensor in the same manner as in example 1 described above, facilitates administrator management, and further allows the downtime of the apparatus to be reduced.

The near-full state can be set in association with the frequency of use, and the workload of the administrator can be lightened and the downtime can be reduced by coordinating the time from "toner near full" to "toner full" with the other devices in the host system.

It is also possible to dispense with the administrator's work of setting the threshold.

In accordance with the present embodiment, the state of the waste toner can be managed by the host computer without using a dedicated sensor, the system is easily managed by the administrator, and the apparatus downtime can be reduced by providing an image-forming apparatus having a transceiver for transmitting and receiving system information to and from a host computer by way of a data communication line, comprising a detection device for detecting the amount of toner deposited on the photoreceptor in the developing unit of the image-forming apparatus; a counting device for counting the number of images to be printed; and a near-full detection device for detecting the near-full state of waste toner by using the detection device and the counting device.

Various modifications will become possible for those skilled in the art after receiving the teachings of the present disclosure without departing from the scope thereof.

What is claimed is:

1. An image-forming apparatus having transmitting and receiving means for transmitting and receiving system information to and from a host computer by way of a data communication line, comprising:

detection means for detecting an amount of toner fed to a photoreceptor in a developing unit of the image-forming apparatus;

determining means for determining an actual amount of toner to be used for a single image by the developing unit prior to image printing;

calculating means for calculating an amount of waste toner to be produced by subtracting the actual amount of toner to be used from the amount of toner fed;

counting means for counting a number of the images to be printed prior to the image printing; and near-full detection means for detecting a near-full state of a waste toner tank by using the detection means, the determining means, the calculating means, and the counting means.

2. The image-forming apparatus as claimed in claim 1, further comprising setting modification means for modifying a setting value whereby it is determined by the near-full detection means that the waste toner tank is in the near-full state.

3. The image-forming apparatus as claimed in claim 2, further comprising calculating means for comparing a time when a previous near-full state or full state was canceled and a time when the near-full state occurred in a current cycle, and calculating an estimated remaining time until reaching a full state in the current cycle.

4. The image-forming apparatus as claimed in claim 2, further comprising display means for displaying information indicating the near-full state on a control portion, and notification means for notifying the host computer of the near-full state by using the transmitting and receiving means when the near-full detection means detects the waste toner to be near full.

5. The image forming apparatus according to claim 1, wherein the detection means is configured to detect the amount of toner deposited on the photoreceptor based on the number of images to be printed and an image forming condition including a charging voltage of a drum, a bias voltage of the toner and a transfer current, an amount of toner deposited on the photoreceptor corresponding to the number of images and the image forming conditions being stored in advance; and the near-full detection means being configured to subtract the detected amount of toner deposited on the photoreceptor from a toner fed amount to determine an amount of waste toner, the amount of waste toner being stored in a non-volatile memory and compared with a preset threshold to detect the near full state of waste toner.

6. The image forming apparatus according to claim 1, wherein the detection mechanism is configured to detect the amount of toner deposited on the photoreceptor based on the number of images to be printed and an image forming condition including a charging voltage of a drum, a bias voltage of the toner and a transfer current, an amount of toner deposited on the photoreceptor corresponding to the number of images and the image forming conditions being stored in advance; and the near-full detection mechanism being configured to subtract the detected amount of toner deposited on the photoreceptor from a toner fed amount to determine an amount of waste toner, the amount of waste toner being stored in a non-volatile memory and compared with a preset threshold to detect the near full state of waste toner.

7. An image-forming apparatus having a transmitting and receiving mechanism configured to transmit and receive system information to and from a host computer by way of a data communication line, comprising:

a detection mechanism configured to detect an amount of toner fed to a photoreceptor in a developing unit of the image-forming apparatus;

a determining mechanism configured to determine an actual amount of toner to be used for a single image by the developing unit prior to image printing;

a calculating mechanism for calculating an amount of waste toner to be produced by subtracting the actual amount of toner to be used from the amount of toner fed;

a counting mechanism configured to count a number of the images to be printed prior to the image printing; and a near-full detection mechanism configured to detect a near-full state of a waste toner tank by using the detection mechanism, the determining mechanism, the calculating mechanism, and the counting mechanism.

8. The image-forming apparatus as claimed in claim 7, further comprising a setting modification mechanism configured to modify a setting value whereby it is determined by the near-full detection mechanism that the waste toner tank is in the near-full state.

9. The image-forming apparatus as claimed in claim 8, further comprising a calculating mechanism configured to compare a time when a previous near-full state or full state was canceled and a time when the near-full state occurred in a current cycle, and calculating an estimated remaining time until reaching a full state in the current cycle.

10. The image-forming apparatus as claimed in claim 8, further comprising a display configured to display information indicating the near-full state on a control portion, and a notification mechanism configured to notify the host computer of the near-full state by using the transmitting and receiving mechanism when the near-full detection mechanism detects the waste toner to be near full.

11. A method of detecting a near-full waste state of waste toner in an image-forming apparatus, the method comprising:

detecting an amount of toner fed to a photoreceptor in a developing unit of the image-forming apparatus;

determining an actual amount of toner to be used for a single image prior to image printing;

calculating an amount of waste toner to be produced by subtracting the actual amount of toner to be used from the amount of toner fed;

counting a number of images to be printed prior to the image printing; and detecting the near-full state of waste toner by using the detected amount of toner, the determined amount of toner, the calculated amount of waste toner, and the counted number of images to be printed.

12. The method of detecting a near-full waste state of waste toner in an image-forming apparatus as claimed in claim 11, further comprising:

modifying a setting value whereby it is determined that a waste toner tank is in a near-full state.

13. The method of detecting a near-full waste state of waste toner in an image-forming apparatus as claimed in claim 12, further comprising:

comparing a time when a previous near-full state or full state was canceled and a time when the near-full state occurred in a current cycle, and calculating an estimated remaining time until reaching a full state in the current cycle.

14. The method of detecting a near-full waste state of waste toner in an image-forming apparatus as claimed in claim 12, further comprising:

displaying information indicating the near-full state on a control portion; and notifying a host computer of the near-full state when the waste toner is near full.

15. The method of detecting a near-full waste state of waste toner in an image-forming apparatus as claimed in claim 11, wherein detecting the amount of toner comprises detecting the amount of toner deposited on the photoreceptor based on the number of images to be printed and an image forming condition including a charging voltage of a drum, a bias voltage of the toner and a transfer current, an amount of toner deposited on the photoreceptor corresponding to the number of images and the image forming conditions being stored in advance; and detecting the near-full state of waste toner comprising substantially the detected amount of toner deposited on the photoreceptor from a toner fed amount to determine an amount of waste toner, storing the amount of waste toner in a non-volatile memory and comparing the amount of waste toner with a preset threshold to detect the near full state of waste toner.

* * * * *